United States Patent [19]

Lewis et al.

[11] 4,236,267

[45] Dec. 2, 1980

[54] CANOE AND PADDLE SUPPORT

[76] Inventors: Michael Lewis, 2754 Hula Dr., Verona, Wis. 53593; Allan L. Jenkins, 4018 Meyer Ave., Madison, Wis. 53711

[21] Appl. No.: 19,703

[22] Filed: Mar. 12, 1979

[51] Int. Cl.[3] ..... B63B 17/00

[52] U.S. Cl. ..... 9/1.7; 224/262; 403/391

[58] Field of Search ..... 248/230; 403/391; 114/270; 115/24.1; 9/1.4, 1.1, 1.7, 6.5, 7; 224/261-264, 309, 318, 327

[56] References Cited

U.S. PATENT DOCUMENTS

| | | | |
|---|---|---|---|
| 451,579 | 5/1891 | Rinfret | 9/1.7 |
| 1,361,211 | 12/1920 | Wilson | 403/391 |
| 3,046,040 | 7/1962 | Luper | 248/230 |
| 3,360,883 | 2/1968 | Glanzer | 403/391 |
| 3,734,367 | 5/1973 | Jackson | 224/262 |
| 3,884,404 | 5/1975 | Frost | 224/318 |
| 4,016,615 | 4/1977 | Main | 9/1.4 |

*Primary Examiner*—Trygve M. Blix
*Assistant Examiner*—D. W. Keen
*Attorney, Agent, or Firm*—Isaksen, Lathrop, Esch, Hart & Clark

[57] ABSTRACT

A canoe and paddle support to facilitate attachment of paddles to a canoe for storage, auto transport, and particularly portaging of the canoe. The invention has a body preferably made of a resilient material. The body has a lateral slot adapted to removably retain the thwart of a canoe, a longitudinal slot adapted to removably retain a canoe paddle and oriented in approximately perpendicular relation to the lateral slot, so that the paddle is held in an orientation approximately longitudinal with respect to the center line of the canoe, and a carrying surface facing downwardly when the thwart and the paddle are retained in the lateral and longitudinal slots and the canoe is inverted, the carrying surface being adapted to provide a convenient path for transmitting the weight of the canoe to the shoulders of the person transporting the canoe. The paddle supports are preferably used in pairs for securing each paddle to two spaced thwarts of the canoe and provide, in combination with the canoe and paddle, a stable support structure.

11 Claims, 5 Drawing Figures

CANOE AND PADDLE SUPPORT

BACKGROUND OF THE INVENTION

1. Field of the Invention

This invention relates to boating equipment and more particularly to equipment for attaching paddles to a conoe for storage and which even more importantly facilitates the portaging of the canoe.

2. Description of the Prior Art

When handling a conoe or traveling by canoe, it is frequently necessary for the user to carry the canoe over land. Particularly, it is often necessary to carry the canoe over the land from one body of water to the next, an activity called portaging. Commonly, and historically, the canoe is inverted, hoisted onto the shoulders of the person portaging the canoe and bodily carried over the trail. The canoe is usually so held that the center thwart, a lateral brace located midway between the ends of the boat, rests on the back of the shoulders and neck. In this position the canoe is substantially balanced and tipped up slightly at the front, allowing the carrier to see where he is going.

Several significant problems are encountered in the course of portaging a canoe. The first is the need to efficiently and comfortably transfer the weight of the canoe to the shoulders of the carrier. A second problem is the need to provide a means for carrying the paddles. A third is the need for some convenient handhold accessible from beneath the inverted canoe to be used by the carrier for steadying his load.

Various arrangements for addressing these problems have been developed. For example, Jackson, U.S. Pat. No. 3,734,367, shows a pack frame adapted to engage the center thwart of the canoe, together with other bracing members extending forward to a second thwart. The pack frame arrangement provides for a more efficient transfer of weight to the carrier of the canoe than can be accomplished simply by resting the middle thwart on the back of the neck and shoulders. Main, U.S. Pat. No. 4,016,615, shows a resilient cushion which attaches to the center thwart of the canoe and which is contoured to fit the back of the neck of the person carrying the canoe. Spring loaded telescopic rods are provided which span the distance between the center thwart and a forward thwart or seat to provide convenient hand holds. Neither patent includes means for attaching the paddles to the canoe. Common practice is to tie the paddles to the seats, thwarts, or other accessible parts of the interior of the canoe.

The devices shown in the art for facilitating the portaging of canoes are cumbersome and require the use of rigid and inconveniently large structures which must then be stored, occupying a relatively large space within the canoe, when the journey by water is resumed. Furthermore, no provision is made thereby for securing the canoe paddles during the portage or during boat storage or transport of the canoe by a car or other vehicle.

SUMMARY OF THE INVENTION

The present invention is summarized in that a canoe and paddle support for use in combination with a canoe having laterally extending thwarts and a canoe paddle having an extended handle to provide a support for carrying the canoe and the paddle, includes a resilient body having a lateral slot adapted to receive and removably retain a thwart of the canoe, a longitudinal slot adapted to receive and removably retain the canoe paddle and having an approximately perpendicular orientation relative to the lateral slot whereby the paddle may be held approximately longitudinal with respect to the centerline of the canoe when the thwart is retained in the lateral slot, and a carrying surface facing downwardly and away from the canoe when the thwart is engaged in the lateral slot, the paddle is engaged in the longitudinal slot, and the canoe is inverted for carrying, whereby the carrying surface will provide a support surface for engagement by a shoulder of a person in supporting relation, and whereby the body will support the canoe on the shoulder of the person for carrying.

A primary object of our invention is to provide a convenient means for attaching a paddle to a canoe for storage, auto transport, and transport by carrying.

A second object of our invention is to provide a means for comfortably transferring the weight of a canoe to the shoulders of a person carrying it.

Another object of our invention is to provide a means for attaching two paddles to a canoe in such a way that the extended handles of the two canoe paddles will provide handholds for a person carrying the canoe by means of which he may steady his load.

A further object of our invention is to provide a canoe and paddle support having a light weight and a compact form so as to conveniently storable within a canoe when the canoe is being used on the water, but which will, in combination with an attached paddle, support the canoe on the user's shoulders for carrying.

Other objects, features, and advantages of our invention will be apparent from the following detailed description taken in conjunction with the accompanying drawings showing preferred embodiments of canoe and paddle supports exemplifying the principles of our invention.

DESCRIPTION OF THE PREFERRED EMBODIMENTS

Figure 2:
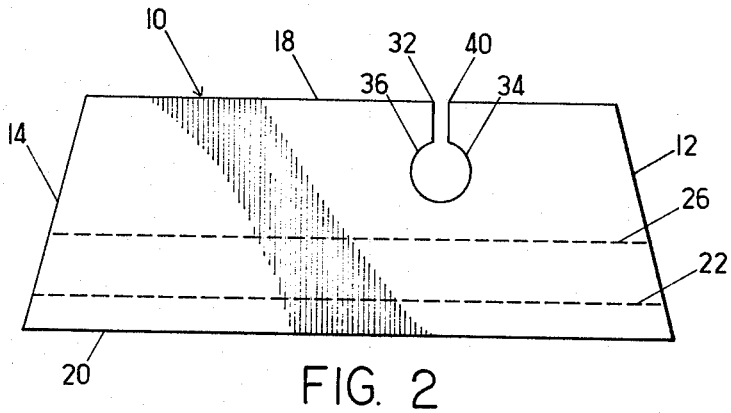
FIG. 2 is a side elevation of our canoe and paddle support.
Figure 3:
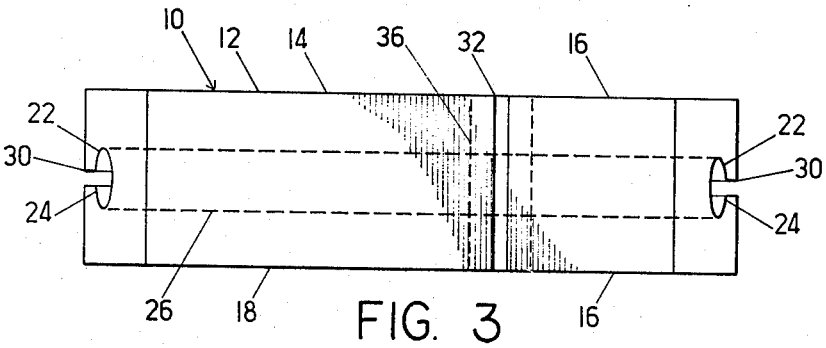
FIG. 3 is a top plan view of the canoe and paddle support shown in FIG. 2.
Figure 4:
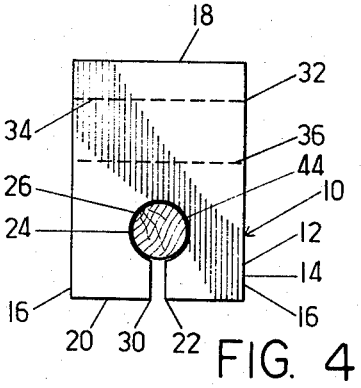
FIG. 4 is an end elevation view of the canoe and paddle support shown in FIG. 2 with a canoe paddle handle, shown in cross-section, retained in the longitudinal slot thereof.

Referring more particularly to the drawings, wherein like numbers refer to like parts, FIGS. 2–4 illustrate a preferred embodiment of our novel canoe and paddle support, shown generally at 10. the canoe and paddle support 10 has a body 12. The body 12 has an outer surface 14 including side surfaces 16, an upper surface 18, and a carrying surface 20. The body 12 may be made of any convenient semirigid, water-resistant material. In the preferred embodiment of our invention the material is resilient cross-linked polyethylene foam. Rubber and polyurethane are examples of other suitable resilient materials.

Figure 5:
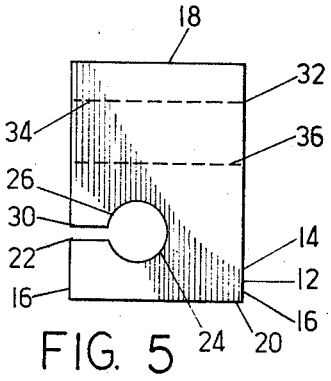
FIG. 5 is an end elevation view of an alternative embodiment of our canoe and paddle support.

The body 12 has a longitudinal slot 22 adapted to receive and removably retain a canoe paddle. Preferably, the longitudinal slot 22 is defined by an internal surface 24 extending longitudinally through the body 12 to form an elongated first holding cavity 26, shown in phantom in FIGS. 2 and 3, and a first neck 30 having a width less than the width of the first holding cavity 26 and extending between the first holding cavity 26 and the outer surface 14 of the body 12. The first holding cavity 26 has a shape selected to correspond substantially to that part of the canoe paddle to be received therein. Preferably the shape is generally cylindrical and of such a size that it will receive the extended handle of common designs and sizes of canoe paddles. The part of the outer surface 14 to which the first neck 30 extends may be the carrying surface 20, as best shown in FIG. 4, or a side surface 16, as shown in the alternative embodiment of FIG. 5. The width of the first neck 30 and the resilience of the material from which the body 12 is made are so selected that the body may be deformed to allow the handle of a canoe paddle to be pushed through the first neck and into the first holding cavity 26. The resilient body is then free to regain substantially its original shape at first neck 30 so that the paddle handle is retained within the holding cavity.

The body 12 also has a lateral slot 32 adapted to receive and removably retain a thwart or other lateral brace of the canoe to be portaged. The lateral slot 32 and the longitudinal slot 22 are oriented in approximate perpendicular relation so that a paddle retained in the longitudinal slot is held approximately longitudinal with respect to the center line of the canoe when a thwart is retained in the lateral slot. The lateral slot 32 is defined by an internal surface 34 extending laterally through the body 12 to form an elongated second holding cavity 36, shown in phantom in FIGS. 3, 4, and 5, and a second neck 40 having a width less than the width of the second holding cavity 36 and extending between the second holding cavity 36 and the outer surface 14 of the body 12. The part of the outer surface 14 to which the second neck 40 extends is preferably the upper surface 18. The second holding cavity 36 is of a size and shape selected to receive the thwart to be retained therein. Preferably the shape is generally cylindrical and of such a size that it corresponds substantially to the size and shape of thwarts commonly found in the size and type of canoe with which the canoe and paddle support is to be used. The width of the second neck 40 and the resiliency of the material from which the body 12 is made are so selected that the body may be deformed to allow a thwart to be pushed through the second neck and into the second holding cavity 36, the resilient body then substantially regaining its original shape to retain the thwart therein in the same manner that the paddle handle is retained in slot 22.

Figure 1:
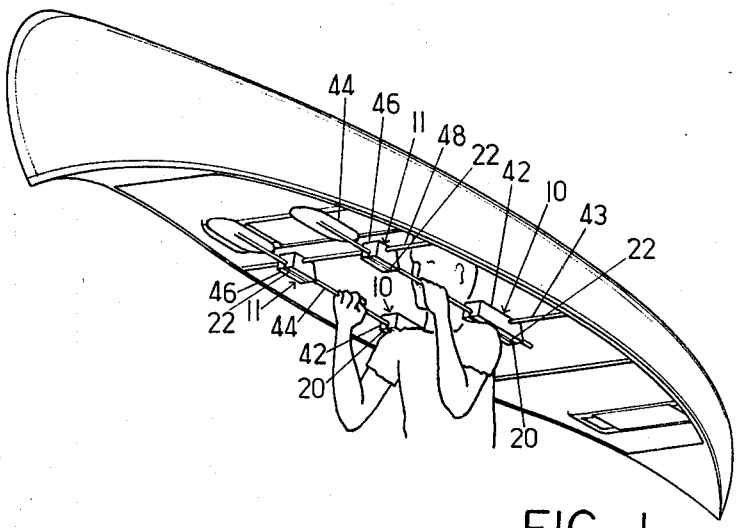
FIG. 1 is a perspective view of a canoe equipped with the canoe and paddle supports of our invention and showing the manner of portaging a canoe according to our invention.

It is thus seen that our canoe and paddle support is useful for removably fastenting a canoe paddle to the thwart of the canoe by engaging the thwart in the lateral slot 32 and the canoe paddle in the longitudinal slot 22. Preferably, the canoe paddle may be made more secure and structurally stable on the canoe by use of a second canoe and paddle support 11, as shown in FIG. 1. The second support 11 is preferably attached to a second thwart or other laterally oriented canoe structural member spaced toward one end of the canoe from the thwart to which the first support is attached, with the extended handle of the paddle engaged in the two, spaced canoe and paddle supports 10 and 11, as shown in FIG. 1. Thus, the paddle is securely but removably attached to the canoe for storage or car-topping, as well as for portaging.

Four of our canoe and paddle supports preferably may be used when it is desired to portage a canoe with two paddles, each to be held securely to the canoe. Two canoe and paddle supports 10 function as shoulder pad units 42, as shown in FIG. 1. A thwart 43 that is located substantially in the middle of the canoe to be portaged is retained in the lateral slot 32 of each shoulder pad unit. The shoulder pad units 42 may be located on the canoe thwart 43 at substantially equal distances from the center line of the canoe and sufficiently apart from each other so as to allow room between them for the head of the person portaging the canoe. The extended handle of a canoe paddle 44 is retained in the longitudinal slot 22 of each shoulder pad unit 42.

The other two canoe and paddle supports 11 serve as paddle hold-down units 46, as shown in FIG. 1. A second thwart 48 of the canoe is retained in the lateral slots 32 of the hold down units 46. Alternatively, a seat member or other laterally extending structure may be used instead of the second thwart 48. the longitudinal slot 22 of each paddle hold-down unit 46 retains another part of the handle of that canoe paddle 44 which is extending along the same side of the canoe, retaining the handle in the manner previously described, as shown in FIG. 1.

With the four canoe and paddle supports so applied to the canoe and the two paddles, the paddles are securely fastened to the canoe. The canoe may then be inverted in the manner common in portaging. The carrying surfaces 20 of the two shoulder pad units 42 are oriented to face downwardly and away from the canoe and may be placed on the shoulders of the person portaging the canoe so as to provide convenient means for transfering the weight of the canoe to the shoulders of the person carrying it. The carrying surfaces 20 may be contoured to receive more comfortably the shoulders of the person carrying the canoe, although even without contouring the natural resilience of the preferred materials will permit some deformation of the carrying surfaces under the load to conform to the body structure of the user.

It can be understood by reference to the drawings that our paddle supports receive the paddle handles and cooperate therewith to provide a structrually stable combination characterized by a rigid longitudinally extending internal member (paddle handle) and a resilient external body member (paddle support) which will comfortably support the attached canoe on the shoulders of the user. Thus, the ability of our paddle supports to utilize the inherent strength of the paddle handles in supporting the canoe contributes to the simplicity, compactness and lack of appreciable weight of our units, and provides a most convenient, low cost, satisfactory product for the canoe owner.

The shoulder pad units 42 and the paddle hold-down units 46 may be substantially identical in structure. However, it is desirable that the shoulder pad units 42 be long enough that the carrying surfaces 20 thereof extend sufficiently beyond the thwart 43 of the canoe to allow room for the head and neck of the person portaging the canoe and provide an extended surface for engagement of the person's shoulders. The paddle hold-down units 46 need not be as long, and are preferably shorter, as shown in FIG. 1, to minimize size, weight, and material, and to facilitate handling and storage when not in use.

Three of our canoe and paddle supports may be used to facilitate the carrying by one person of a canoe and a single paddle. One of the canoe and paddle supports may be used as a shoulder pad unit 42 wherein the handle of the canoe paddle 44 may be retained, as described above. A second of the canoe and paddle supports may serve as a paddle hold-down unit 46, securing another part of the extended handle of the canoe paddle 44, as described above. The third canoe and paddle support may be engaged with the middle thwart 43, in the manner described for shoulder pad units 46.

The canoe may then be inverted, and the carrying surfaces 20 of the shoulder pad units 42 placed on the shoulders of the person portaging the canoe. Because there is no second paddle engaged by the second paddle hold-down unit, imparting longitudinal stability thereto, the carrier may find it necessary to shift the position of the canoe so that his shoulder is substantially beneath the thwart 43. This may be done by bowing the head and shifting the entire canoe forward until the thwart 43 is substantially over both shoulders. Alternatively, the canoe may be so carried that its center line is at a slight angle to the direction in which the carrier is facing. With the canoe so oriented, the middle thwart 43 may be allowed to pass substantially over the shoulder associated with the shoulder pad unit that is not engaging a paddle, the thwart then passing behind the carrier's neck. The other shoulder pad unit may be selected to be sufficiently long that its carrying surface 20 extends to and may be allowed to rest upon the carrier's other shoulder.

The handles of the two canoe paddles 44 when fastened to the canoe by means of four of our canoe and paddle supports 10, as described above, may be grasped by the person portaging the canoe and used as convenient hand holds for steadying the load, as shown in FIG. 1. Thus, when used in combination with a canoe and two paddles, four of our canoe and paddle supports provide an extremely light weight means for firmly attaching two paddles to a canoe in a stable, rigid manner, means for comfortably transferring the weight of the canoe to the shoulders of the person carrying it and for supporting the canoe thereon in a stable manner, and convenient hand holds available to the carrier for steadying the canoe as he carries it. Furthermore, our invention provides a convenient means for attaching the canoe paddles to the canoe for storage or while car-topping the boat. When not in use, our supports may be easily stowed in the ends of the canoe or other convenient locations without adding appreciable weight to the canoe or taking up significant storage space.

Occasionally canoes are made with a middle thwart but with no second thwart located close enough to the middle thwart to allow canoe paddles to span the distance between them. In such a case, an additional thwart or other lateral brace may be installed in the canoe by any convenient means at a location selected to allow a canoe paddle to be engaged in the longitudinal slots of two canoe and paddle supports that are engaged on the middle and additional thwarts in the manner described above.

It is understood that our invention is not confined to the particular construction, materials, and arrangement of parts herein illustrated and described, and that various changes may be made without departing from the spirit of our invention. Our invention embraces all such modified forms thereof as come within the scope of the following claims.

We claim:

1. A canoe and paddle support for use in combination with a canoe having laterally extending thwarts and a canoe paddle having an extended handle to provide a support for carrying the canoe and the paddle, comprising a body having:

(a) a lateral slot adapted to receive and removably retain a thwart of the canoe, (b) a longitudinal slot adapted to receive and removably retain the canoe paddle and having an approximately perpendicular orientation relative to the lateral slot, whereby the paddle may be held approximately longitudinal with respect to the center line of the canoe when the thwart is retained in the lateral slot, and (c) a carrying surface facing downwardly and away from the canoe when the thwart is engaged in the lateral slot, the paddle is engaged in the longitudinal slot, and the canoe is inverted for carrying, whereby the carrying surface will provide a support surface for engagement by the shoulder of a person in supporting relation, and whereby the body will support the canoe on the shoulder of the person for carrying.

2. The canoe and paddle support specified in claim 1 wherein the carrying surface is contoured to conform to the shoulder of a person carrying the canoe.

3. The canoe and paddle support specified in claim 1 wherein the body is resilient polyethylene foam.

4. The canoe and paddle support of claim 1 wherein (a) the body is resilient and has an outer surface which includes the carrying surface, an upper surface, and a side surface, (b) the longitudinal slot is defined by an internal surface extending longitudinally through the body to form an elongated first holding cavity and a first neck extending from the first holding cavity to the outer surface, the first holding cavity having a shape selected to correspond substantially to that part of the canoe paddle to be received therein and the first neck having a width narrower than the width of the first holding cavity, whereby a canoe paddle may be pushed through the first neck and into the first holding cavity and be retained therein, and (c) the lateral slot is defined by an internal surface extending laterally through the body to form an elongated second holding cavity and a second neck extending from the second holding cavity to the upper surface, the second holding cavity having a shape selected to correspond substantially to that part of the thwart to be received therein and the second neck having a width narrower than the width of the second holding cavity, whereby the thwart may be pushed through the second neck into the second holding cavity and be retained therein.

5. The canoe and paddle support of claim 4 wherein the first holding cavity is generally cylindrical in shape and of a size selected to correspond substantially to the size of the extended handle of the canoe paddle to be received therein, and wherein the second holding cavity is generally cylindrical in shape and has a size selected to correspond substantially to the size of the thwart to be retained therein.

6. The canoe and paddle support of claim 4 wherein that part of the outer surface to which the first neck extends is the carrying surface.

7. The canoe and paddle support of claim 4 wherein that part of the outer surface to which the first neck extends is a side surface.

8. A canoe and paddle support for use in combination with a canoe having laterally extending thwarts and a canoe paddle having an extended handle to provide support for carrying the canoe and the paddle, comprising a resilient body having:

(a) means for engaging and removably retaining a first thwart of the canoe, (b) means for engaging and removably retaining the handle of the canoe paddle in an orientation approximately longitudinal with respect to the center line of the canoe when the thwart is engaged in the thwart engaging means, and (c) a carrying surface facing downwardly and away from the canoe when the body is engaged on the thwart and the handle and the canoe is inverted for carrying, whereby the carrying surface will provide an extended support surface for engagement by the shoulder of a person in supporting relation, and whereby the body will support the paddle and the canoe on the shoulder of the person for carrying.

9. The canoe and paddle support specified in claim 8 wherein the canoe and paddle support is a shoulder pad unit, and including in combination therewith a pddle hold-down unit comprising a resilient body having:

(a) means for engaging and removably retaining a second thwart of the canoe located in spaced relation to the first thwart, and (b) means for engaging and removably retaining the extended handle of the canoe paddle whereby the paddle, the shoulder pad unit, and the paddle hold-down unit may be fastened and removably retained on the canoe in a fixed, longitudinally extended position.

10. The canoe and paddle support specified in claim 9 including a second shoulder pad unit and a second paddle hold-down unit, whereby the second paddle may be fastened to the canoe in substantially parallel relation to the first canoe paddle, whereby the paddles, the canoe, the shoulder pad units, and the paddle hold-down units may be removably retained in fixed, longitudinally extending position so that the shoulder pad units may be supported on the shoulders of a carrier of the canoe and the handles of the canoe paddles may be used as hand holds by the carrier for stabilizing the canoe as he carries it.

11. A kit for attaching a pair of paddles with extended handles to a canoe having a middle thwart and at least one other thwart remote from the middle thwart for paddle storage and support of the canoe during carrying, comprising:

(a) two shoulder pad units, each unit having a body made of resilient material, a lateral slot in the body adapted to receive and removably retain the middle thwart of the canoe, a longitudinal slot in the body adapted to receive and removably retain the handle of a canoe paddle and being oriented approximately perpendicular relative to the lateral slot whereby the paddle may be held in an orientation approximately longitudinal with respect to the center line of the canoe when the middle thwart is retained in the lateral slot, and a carrying surface facing downwardly and away from the canoe when the body is engaged in the middle thwart and the canoe paddle, and the canoe is inverted for carrying, and (b) two paddle hold-down units, each unit having a body made of a resilient material, a lateral slot in the body adapted to receive and removably retain the other thwart of the canoe remote from the middle thwart and a longitudinal slot in the body adapted to receive and removably retain the extended handle of a canoe paddle being held by a shoulder pad unit, whereby each canoe paddle may be securely fastened in substantially rigid relation to the canoe by a shoulder pad unit and a corresponding paddle hold-down unit, whereby the carrying surfaces of the two shoulder pad units provide an extended support surface for engagement by the shoulders of a person in supporting relation, and whereby the bodies of the two shoulder pad units will support the paddle and the canoe on the shoulders of the person for carrying, and the extended handles of the two canoe paddles will provide hand holds for the person carrying the canoe with which he may steady the canoe as he carries it.

* * * * *